US010054311B2

(12) United States Patent
Wild et al.

(10) Patent No.: US 10,054,311 B2
(45) Date of Patent: Aug. 21, 2018

(54) BURNER FOR BURNING A PULVERULENT FUEL FOR A BOILER HAVING A PLASMA IGNITION TORCH

(71) Applicant: ALSTOM Technology Ltd, Baden (CH)

(72) Inventors: Thomas Wild, Stuttgart (DE); Hellmuth Brueggemann, Esslingen (DE)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 1034 days.

(21) Appl. No.: 14/306,627

(22) Filed: Jun. 17, 2014

(65) Prior Publication Data

US 2014/0290544 A1 Oct. 2, 2014

Related U.S. Application Data

(63) Continuation of application No. PCT/IB2012/056882, filed on Nov. 30, 2012.

(30) Foreign Application Priority Data

Dec. 20, 2011 (DE) ..... 10 2011 056 655

(51) Int. Cl.
*F23Q 7/02* (2006.01)
*F23D 1/00* (2006.01)

(52) U.S. Cl.
CPC ..... *F23Q 7/02* (2013.01); *F23D 1/00* (2013.01); *F23C 2900/99005* (2013.01); *F23D 2207/00* (2013.01)

(58) Field of Classification Search
CPC ..... F23D 1/00; F23D 2207/00; F23C 2900/99005; F23Q 7/02; H05H 1/26
See application file for complete search history.

(56) References Cited

U.S. PATENT DOCUMENTS 4,089,628 A 5/1978 Blackburn
4,228,747 A 10/1980 Smirlock et al.
(Continued)

FOREIGN PATENT DOCUMENTS

CN 85105549 A 1/1987
DE 2820931 A1 11/1979
(Continued)

OTHER PUBLICATIONS

European standard EN 12952-9, Water-tube boilers and auxiliary installations, BSI Jan. 7, 2003.
(Continued)

*Primary Examiner* — David J Laux
(74) *Attorney, Agent, or Firm* — GE Global Patent Operation; Stephen G. Midgley

(57) ABSTRACT

The invention relates to a pulverized coal burner for a steam generator. The pulverized coal burner has a fuel duct, through which pulverized coal is conveyed with the aid of a carrier gas. The pulverized coal emerges together with the carrier gas at a fuel duct outlet. The pulverized coal burner furthermore has at least one core duct and at least one secondary duct. Air or oxygen flows through the core duct and the secondary duct, emerging at the core duct outlet and at the secondary duct outlet. The core duct outlet, the secondary duct outlet and the fuel duct outlet together form a burner outlet. The pulverized coal burner has at least one plasma ignition torch embodied integrally with the pulverized coal burner. The outlet of the at least one plasma ignition torch is arranged in the plane of the burner outlet or offset downstream in relation to the direction of flow of the pulverized coal. The plasma flame produced by the plasma ignition torch is thus located outside the fuel duct.

19 Claims, 4 Drawing Sheets

(56) References Cited

U.S. PATENT DOCUMENTS

| | | | | |
|---|---|---|---|---|
| 4,438,707 | A * | 3/1984 | Delaplace | F23C 1/12 110/263 |
| 4,836,772 | A | 6/1989 | Larue | |
| 4,862,814 | A | 9/1989 | Campbell et al. | |
| 5,156,100 | A | 10/1992 | Pentti | |
| 5,687,658 | A | 11/1997 | Streffing et al. | |
| 5,689,949 | A | 11/1997 | DeFreitas et al. | |
| 5,845,480 | A | 12/1998 | DeFreitas et al. | |
| 7,430,970 | B2 * | 10/2008 | LaRue | F23C 7/008 110/261 |
| 2006/0000395 | A1 | 1/2006 | Joshi et al. | |
| 2010/0307391 | A1 | 12/2010 | Tamura et al. | |
| 2016/0238239 | A1 | 8/2016 | Leisse et al. | |

FOREIGN PATENT DOCUMENTS

| | | | |
|---|---|---|---|
| DE | 19521505 | B4 | 7/2004 |
| DE | 102006011326 | A1 | 9/2007 |
| DE | 102013111504 | A1 | 4/2015 |
| EP | 0108923 | A1 | 5/1984 |
| EP | 0 163 423 | | 12/1985 |
| EP | 1747977 | A1 | 1/2007 |
| EP | 2 253 884 | | 11/2010 |
| JP | 60194211 | | 10/1985 |
| JP | 11354290 | | 12/1999 |
| JP | 2012112549 | | 6/2012 |

OTHER PUBLICATIONS

Photos of the gas lances of the pulverized coal burner mouths of the power plant Rodenhuize, Munich and Solvay (Rheinberg).

* cited by examiner

B-B
20
21
22
25
26
27
28
29
30
31
32
33
34
37
38
39
40
41
42
A
B
D1
D2
E
K
L

BURNER FOR BURNING A PULVERULENT FUEL FOR A BOILER HAVING A PLASMA IGNITION TORCH

CROSS-REFERENCE TO RELATED APPLICATIONS

This application claims priority to PCT/IB2012/056882 filed Nov. 30, 2012, which claims priority to German application 102011056655.4 filed Dec. 20, 2011, both of which are hereby incorporated in their entireties.

TECHNICAL FIELD

The present invention relates to a burner for burning a pulverulent fuel, such as a pulverized coal burner, which is suitable and provided for use in a boiler for steam generation. In addition to pulverized coal, dust from biomass or from a mixture of biomass and coal can be used as a pulverulent fuel.

BACKGROUND

Burners for burning a pulverulent fuel are known. They supply the boiler with a pulverulent fuel and air or some other oxygen-containing gas or oxygen in order to burn the pulverulent fuel, in particular pulverized coal, and, in the process, to generate heat. To ignite such burners, ignition torches are provided. The ignition torches can be embodied as separate ignition torches or as integral ignition torches forming a unit with the pulverized coal burner. To produce the ignition flame, the ignition torch is usually supplied with a gaseous or liquid fuel.

The disadvantage with such known burners is the demand for fuels, usually fossil fuels, to produce the ignition flame. The carbon dioxide emissions of such burners are generally high and, owing to the rising trend in oil and gas prices, burners of this kind are becoming increasingly uneconomical to operate.

As an alternative to gas- or oil-fueled ignition torches, there have also been attempts to ignite the pulverulent fuel supplied via the burner at electrically heated surfaces of the burner. Most recently, plasma ignition torches have furthermore been developed, said torches using a plasma flame as a source of ignition for the burner. In contrast to oil or gas flames, the plasma flame is significantly shorter and hotter. The advantage in using plasma flames is that the ignition torch does not require fossil fuels.

A pulverized coal burner with an integrated plasma ignition torch is known from EP 2 253 884 A1, for example. The pulverized coal burner has a fuel duct, via which the pulverized coal can be passed through the burner. The fuel duct is substantially cylindrical. There is also a flow of air through said fuel duct. A plasma ignition torch is arranged centrally along the burner center line in the fuel duct. The pulverized coal/air mixture is ignited in the pulverized coal burner and is then discharged at the burner outlet.

U.S. Pat. No. 5,689,949 and U.S. Pat. No. 5,845,480 describe burners with a plasma ignition device. Within the burner, a fuel/air mixture is introduced into a chamber and is ignited there by a plasma ignition device arranged on the chamber wall.

In the burner known from U.S. Pat. No. 5,156,100 A, the fuel is divided into a main flow and an additional flow. The additional flow is ignited with the aid of a plasma ignition torch and is then mixed with the main flow of fuel, thereby igniting the latter as well.

Starting from the various known burners with an integrated plasma ignition torch, one object of the present invention can be considered to be that of providing a pulverized coal burner in which the outlay on maintenance and testing is low and which prevents backfires into the supply line for the pulverulent fuel.

SUMMARY

This object is achieved by a burner for burning a pulverulent fuel having the features of patent claim 1.

According to the invention, the burner for burning a pulverulent fuel has a fuel duct, through which the pulverulent fuel, e.g. pulverized coal, flows and emerges at a fuel duct outlet. The burner furthermore has a core duct having a core duct outlet and/or a secondary duct having a secondary duct outlet. Oxygen or an oxygen-containing gas or air or even air enriched with oxygen flows through the core duct and the secondary duct. The pulverized coal burner furthermore has at least one integrated plasma ignition torch. The at least one plasma ignition torch in each case produces a plasma flame. This is formed outside the fuel duct, in particular close or adjacent to the fuel duct outlet. Downstream of the fuel duct outlet, the pulverulent fuel emerging there comes into contact with the plasma flame. The pulverulent fuel is therefore ignited by the plasma flame outside the fuel duct.

This ensures that there is no backfiring through the fuel duct and into the supply line for the pulverized coal. On the other hand, more stable ignition of the pulverulent fuel can be accomplished by means of this arrangement. Downstream of the fuel duct outlet, the pulverulent fuel emerging there is mixed with the air or the gas containing oxygen or with oxygen in the core duct and/or the secondary duct. The plasma flame is located in this turbulent mixing zone. Despite the short length of said flame, this arrangement of the plasma flame ensures reliable ignition of the dust/gas mixture outside the burner. The use of a plasma ignition torch eliminates the need for supply lines for gaseous or liquid fossil fuel. The pulverized coal burner with an integrated plasma ignition torch can be embodied in such a way that retrofitting of boilers that have pulverized coal burners fitted with oil or gas ignition torches is possible. Burner monitoring for open-loop or closed-loop control of the burner is very simple since there are no separate ignition torches or auxiliary burners.

The plasma ignition torch can have a gas duct and ignition electrodes, which are arranged in the region of the gas duct outlet. Air as a carrier gas, for example, can be passed through the gas duct to produce the plasma flame.

It is advantageous if the fuel duct outlet and the core duct outlet are located in a common plane. There, they jointly form a burner outlet of the pulverized coal burner. In one illustrative embodiment, the secondary duct outlet can also lie in a common plane with the fuel duct outlet and/or the core duct outlet. The plasma flame for igniting the pulverized fuel/gas mixture is produced downstream of the burner outlet.

Here, it is also possible, in particular, for the gas duct outlet of the plasma ignition torch and the fuel duct outlet to be arranged in a common plane. In this embodiment, all the duct outlets lie in a common plane and form the burner outlet. As an alternative, the gas duct outlet could also be arranged offset in a downstream direction relative to the fuel duct outlet.

Owing to the plasma flame provided downstream of the burner outlet, an inerted pulverized fuel/gas mixture can also be used to transport the pulverulent fuel to the burner.

The burner for burning a pulverulent fuel can have a plurality of secondary ducts and/or a plurality of core ducts. There is preferably likewise a plurality of plasma ignition torches. The plasma ignition torches are arranged within the core duct cross section and/or within the coal duct cross section and/or within the secondary duct cross section. In particular, the plasma ignition torches are located outside a burner center line if the burner for burning a pulverulent fuel is embodied as an annular burner, for example. It has been found that ignition of the pulverized fuel/gas mixture is inadequate if a central plasma ignition torch is arranged along the burner center line. In annular burners, the core duct is provided along the burner center line. Complete envelopment of the plasma flame by an oxygen-containing gas or by oxygen from the core duct leads to inadequate contact between the plasma flame and the pulverulent fuel. It is therefore advantageous if the at least one plasma ignition torch is arranged offset relative to the burner center line and, preferably, in the region of a partition wall between the fuel duct and the core duct or on a partition wall between the fuel duct and the secondary duct. At these locations, there is both sufficient oxygen-containing gas or oxygen and sufficient pulverized coal for reliable ignition of combustion.

In a preferred illustrative embodiment, there is a plurality of plasma ignition torches on a common circle or on a plurality of concentric circles around the burner center line. As an alternative or in addition, it is also possible for the plasma ignition torches to be arranged along different radial planes, which are oriented radially with respect to the burner center line. The radial planes can be arranged in a regularly or irregularly distributed manner in the circumferential direction around the burner center line. Such a geometric arrangement of the plasma ignition torches leads to a further improvement in ignition of the pulverulent fuel, especially in the case of burners for burning a pulverulent fuel which are embodied as annular burners.

As mentioned, the burner can be embodied as an annular burner. In this case, the fuel duct is embodied as an annular duct and surrounds the core duct coaxially. In turn, at least one secondary duct embodied as an annular duct surrounds the fuel duct coaxially.

As an alternative to this embodiment of the burner, said burner can also have a rectangular fuel duct cross section. A plurality of core ducts, the core duct outlets of which are positioned along axes which form a cross or grid structure, can be arranged within the fuel duct cross section. As an alternative or in addition, there is preferably also a plurality of plasma ignition torches, which are arranged along axes forming the cross structure or grid structure, in particular directly between two core ducts in each case. This results in very good contact between the plasma flame and the emerging pulverulent fuel and, at the same time, adequate mixing with oxygen-containing gas, in particular air, or oxygen from the core ducts.

In this arrangement, it may furthermore be advantageous if at least one plasma ignition torch is arranged between the fuel duct and the secondary air duct. Particularly good ignition of the pulverulent fuel is also achieved in the transition zone from the fuel duct to the secondary air duct.

Advantageous embodiments of the invention can be obtained from the dependent patent claims and from the description. The description is limited to essential features of the invention. The drawing should be used as an additional aid. Illustrative embodiments of the pulverized coal burner are explained in detail below with reference to the attached drawing, in which:

DETAILED DESCRIPTION

The invention relates to a burner for burning a pulverulent fuel. The pulverulent fuel can be produced from coal, biomass or a coal/biomass mixture. In the illustrative embodiment described here, pulverized coal K is preferably used as the pulverulent fuel. The burner for burning a pulverulent fuel is therefore referred to below as a pulverized coal burner 20. However, the invention can also be used for other pulverulent fuels.

The pulverized coal burner 20 is provided for a boiler, e.g. a steam generator. The boiler has a combustion chamber wall 21, which completely surrounds a combustion chamber 22. A plurality of pulverized coal burners 20 is usually arranged in the combustion chamber wall 21. The pulverized coal K supplied via the pulverized coal burner 20 is burnt in the combustion chamber 22 to generate heat. The heat is used to produce steam.

Figures 1A, 1B, 1C:
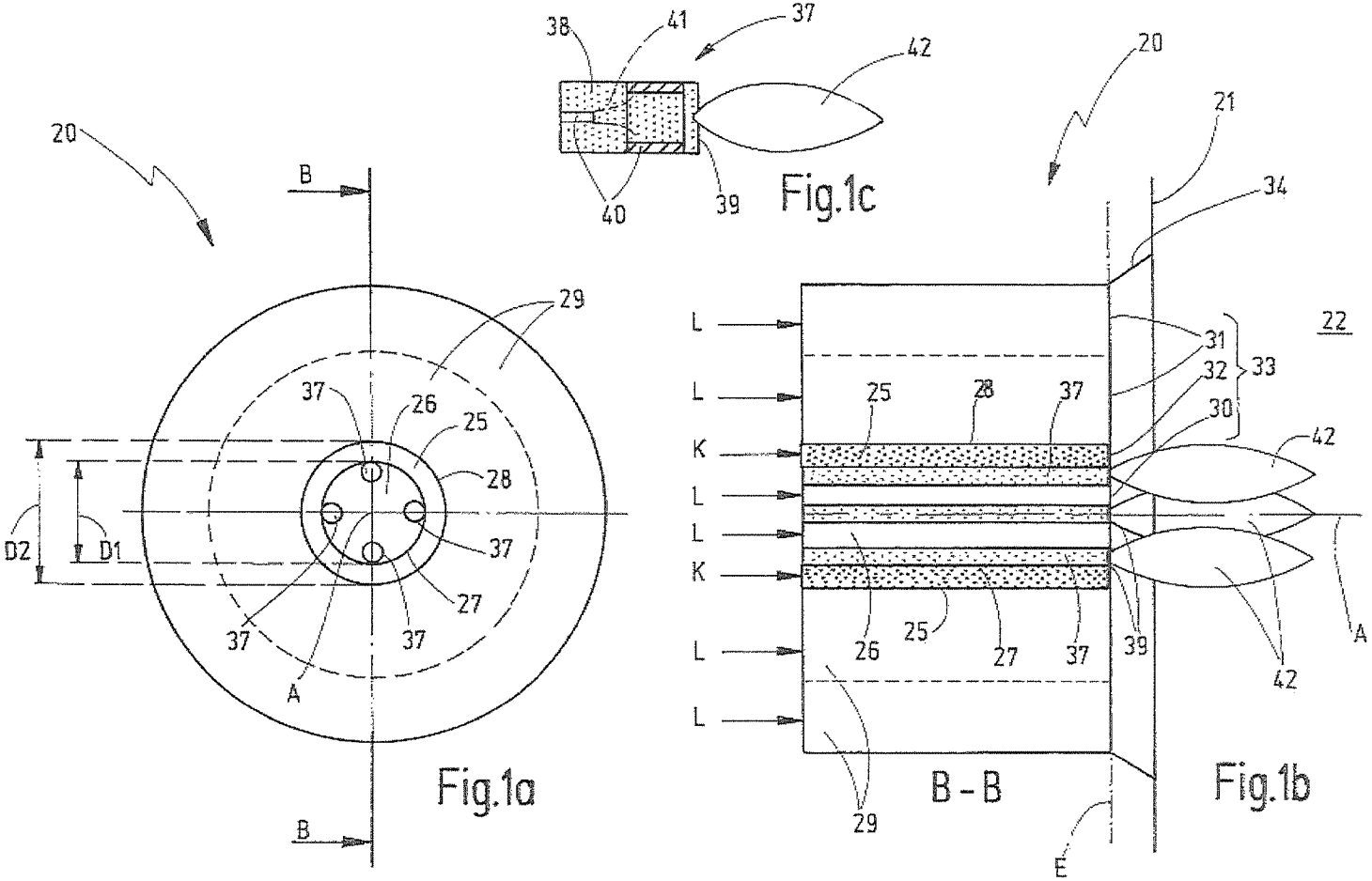
FIG. 1*a* shows an illustrative embodiment of a burner for burning a pulverulent fuel in the form of a pulverized coal burner in a plan view of the burner outlet.
FIG. 1*b* shows the illustrative embodiment of the pulverized coal burner according to FIG. 1*a* in a schematic cross-sectional view along section line B-B.
FIG. 1*c* shows a schematic cross-sectional view of part of a plasma ignition torch of the pulverized coal burner according to FIGS. 1*a* and 1*b*.

A first illustrative embodiment of a pulverized coal burner 20 is shown in FIGS. 1*a* and 1*b* in a highly schematized form similar to a block diagram. The pulverized coal burner 20 shown there is embodied as an annular burner. It has an annular fuel duct 25. The fuel duct 25 is arranged coaxially with a burner center line A. The outside diameter of the fuel duct 25 is denoted by D2 and the inside diameter is denoted by D1. Running along the burner center line A is a core duct 26. In the pulverized coal burner 20 embodied as an annular burner, the core duct 26 has a cylindrical, and preferably circular-cylindrical, shape. Oxygen, or preferably air L, flows through the core duct 26. The core duct 26 and the fuel duct 25 are immediately adjacent to one another. They are separated from one another by a hollow-cylindrical first partition wall 27. Arranged coaxially around the first hollow-cylindrical partition wall 27, with a spacing in between, is a second hollow-cylindrical partition wall 28, which separates the fuel duct 25 from a secondary duct 29 embodied as an annular duct. The secondary duct 29 is thus immediately adjacent to the fuel duct 25 and surrounds the latter in a ring shape. As a modification of the illustrative embodiment shown in FIGS. 1*a* and 1*b*, there can also be a plurality of annular secondary ducts 29 arranged concentrically with one another.

Oxygen or oxygen-containing gas and, for example, air L flows through the core duct 26 and through the at least one secondary air duct 29. The air L emerges at a core duct outlet 30 of the core duct 26 and at a secondary duct outlet 31 of the relevant secondary duct 29.

Pulverized coal K, which is supplied to the pulverized coal burner 20 via supply lines (not shown), flows through the fuel duct 26. The pulverized coal K emerges from the pulverized coal burner 20 at a fuel duct outlet 32. In the preferred illustrative embodiment shown, the fuel duct outlet 32 is located in a plane E. The core duct outlet 30 and/or the respective secondary duct outlet 31 of the at least one secondary duct 29 of the pulverized coal burner 20 can also be arranged in said plane E. A burner outlet 33 of the pulverized coal burner 20 is formed in plane E. By way of example, the duct outlets 30, 31, 32 together form the burner outlet 33 of the pulverized coal burner 20. As an alternative, the secondary duct outlet 31 of the respective secondary duct 29 could also be arranged offset downstream relative to the core duct outlet 30 and/or to the fuel duct outlet 32. As illustrated schematically in FIG. 1*b*, the burner outlet 33 is arranged slightly offset relative to the combustion chamber wall 21. The burner outlet 33 is connected to the combustion chamber wall 21 by a mouthpiece 34. The mouthpiece 34 has the shape of a frustoconical surface and widens conically from the burner outlet 33 to the combustion chamber wall 21.

To ignite and/or assist combustion of the pulverized coal K supplied via the fuel duct 25, the pulverized coal burner 20 according to the invention has at least one and, according to the example, a plurality of plasma ignition torches 37. Each plasma ignition torch 37 has a gas duct 38, through which a carrier gas, e.g. air, flows. In the region of the gas duct outlet 39, the plasma ignition torch 37 has two ignition electrodes 40. An arc 41 is formed between the two ignition electrodes 40 by applying a voltage and, as a result, the carrier gas flowing through the gas duct forms a plasma flame 42, as shown schematically in FIG. 1*c*. Apart from FIG. 1*c*, the plasma ignition torch 37 is illustrated schematically in all the other figures by the gas duct 38 and the gas duct outlet 39. In the case of the plasma ignition torches 37 shown in FIG. 1*c*, which are shown in a highly schematized form, the anode is of hollow-cylindrical configuration. The cathode is embodied as a central cylindrical or hollow-cylindrical element along the longitudinal axis upstream of the anode. The inside diameter of the anode is greater than the diameter of the cathode, allowing the carrier gas to flow around the cathode through the inside of the anode, with the plasma flame 42 being ignited by the arcs 41 that are present there. The cathode can have cooling ducts for water cooling.

The gas duct outlet 39 is located outside the fuel duct 25. The pulverized coal supplied via the fuel duct 25 therefore enters into contact with the plasma flame 42 only downstream of the fuel duct outlet 32 thereof. Ignition of the pulverized coal within the fuel duct 25 is avoided. In the preferred illustrative embodiment, the gas duct outlet 39 is located at the level of the burner outlet 33 in the direction of flow along the burner center line. As an alternative, the gas duct outlet 39 of the at least one plasma ignition torch could also be arranged offset downstream relative to the fuel duct outlet 32 or burner outlet 33, e.g. within the region of the mouthpiece 34. The essential point for the configuration according to the invention of the pulverized coal burner 20 is that the pulverized coal enters into contact with the plasma flame 42 only downstream of the fuel duct outlet 32.

Figure 6:
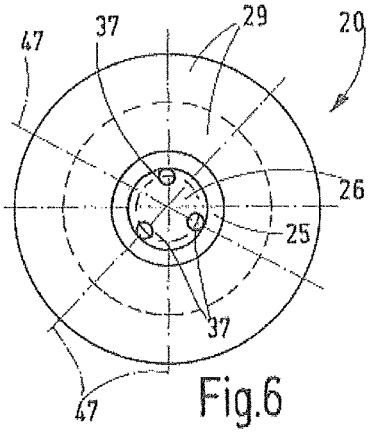
Figure 7:
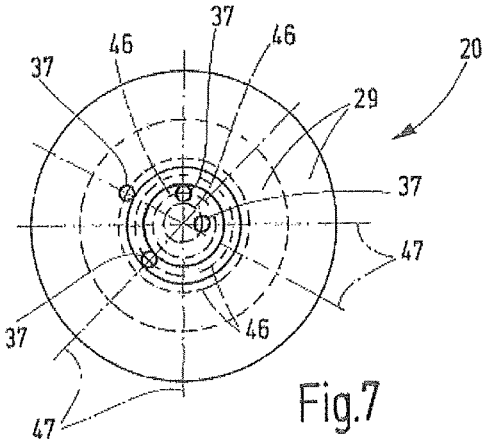

There are many possible variations of the number and arrangement of the plasma ignition torches 37. In all cases, the plasma ignition torches are arranged offset relative to the burner center line A. In the first illustrative embodiment according to FIGS. 1*a*, 1*b* and 3, there are four plasma ignition torches 37, which are arranged within the core duct cross section. In this illustrative embodiment, the plasma ignition torches 37 are arranged immediately adjacent to the first partition wall 27 in a manner distributed regularly in the circumferential direction U. In the region of the first partition wall 27, the plasma flames 42 achieve very good contact with the pulverized coal emerging from the fuel duct 25. At the same time, sufficient air L is supplied via the core duct 26, thus making it possible to ensure reliable ignition or maintenance of combustion. As a modification of this first illustrative embodiment shown in FIGS. 1*a* and 1*b*, the selected number of plasma ignition torches 37 within the core duct cross section can also be greater or smaller, e.g. it is also possible for just two or three plasma ignition torches to be provided, as illustrated schematically in FIG. 6.

Figure 2:
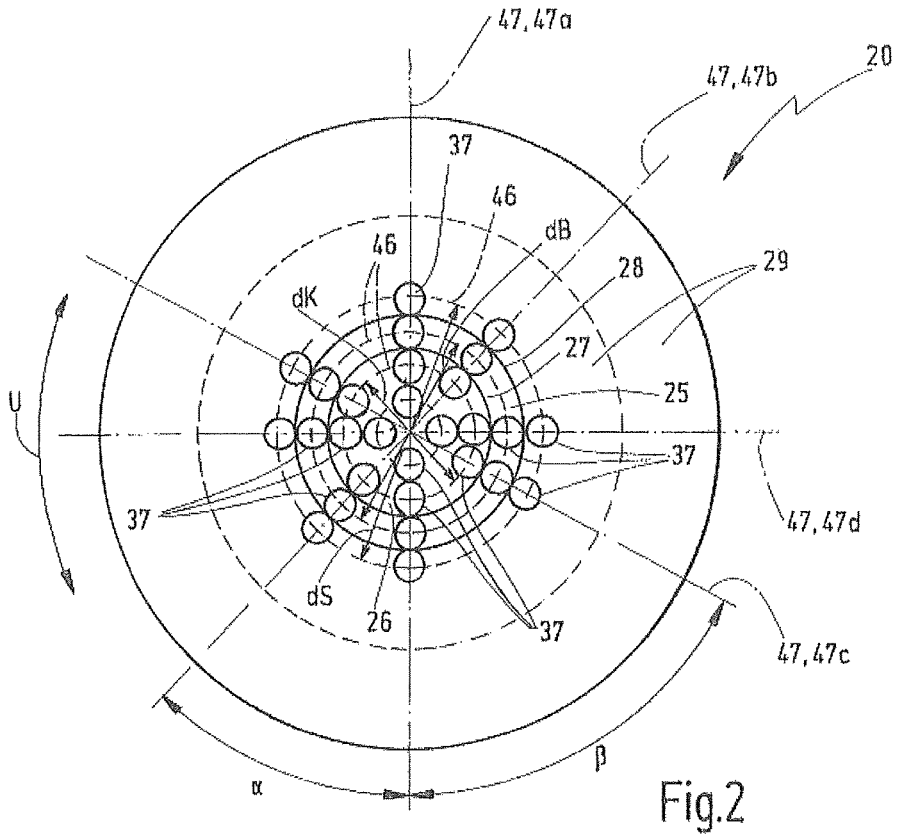
FIG. 2 shows the pulverized coal burner according to FIGS. 1*a* and 1*b*, wherein possible positions of one or more integrated plasma ignition torches are shown.

In FIG. 2, those positions which are possible for the arrangement of the plasma ignition torches 37 in the illustrative embodiment of the annular pulverized coal burner described here are shown. In this case, the following principle of arrangement has been taken into account. On the one hand, a plurality of and, according to the example, four circles 46 have been specified concentrically with the burner center line A. All possible positions of arrangement for the plasma torches 37 are located on these circles 46, concentrically around the burner center line A. A plurality of radial planes 47 are defined radially with respect to the burner center line A. In the illustrative embodiment, four radial planes 47 are specified. All possible positions of arrangement for the plasma ignition torches 37 are located at the points of intersection between the circles 46 and the radial planes 47 (FIG. 2). The positions indicated in FIG. 2 for the plasma ignition torches 37 are not all occupied. In general, two to six or eight plasma ignition torches 37 are sufficient.

The diameter of a circular path 46 within the core duct cross section is denoted by dK, the diameter of a circular path 46 within the fuel duct cross section is denoted by dB, and the diameter of a circular path 46 in the secondary duct cross section is denoted by dS (FIG. 2).

In the illustrative embodiment, the radial planes 47 are arranged in an irregularly distributed manner in circumferential direction U. A first angle $\alpha$ between a first radial plane 47*a* and an immediately adjacent second radial plane 47*b* is different from a second angle $\beta$ between the first radial plane 47*a* and a third radial plane 47*c* provided on the other side, immediately adjacent to the first radial plane 47*a*. A fourth radial plane 47*d* is aligned at right angles to the first radial plane 47*a*.

In FIGS. 3 to 11, various possible arrangements of, in each case, a plurality of plasma ignition torches 37 are illustrated on the basis of the basic pattern shown in FIG. 2. The number of plasma torches 37 provided and/or the respective positions thereof can vary.

The arrangement shown in FIG. 3 has four plasma ignition torches 37 within the core duct cross section, as has already been described in connection with FIG. 1*a*. In the arrangement shown in FIG. 4, a plurality of plasma ignition torches 37 is arranged directly adjoining the second partition wall 28. In this case, the plasma ignition torches 37 are located within the secondary duct cross section of the secondary duct 29.

Figure 3:
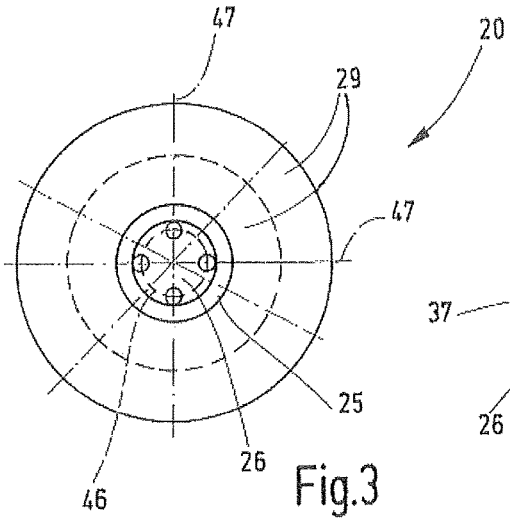
FIGS. 3 to 11 show different arrangements of integrated plasma ignition torches in the pulverized coal burner according to FIGS. 1*a*, 1*b* and 2.
Figure 4:
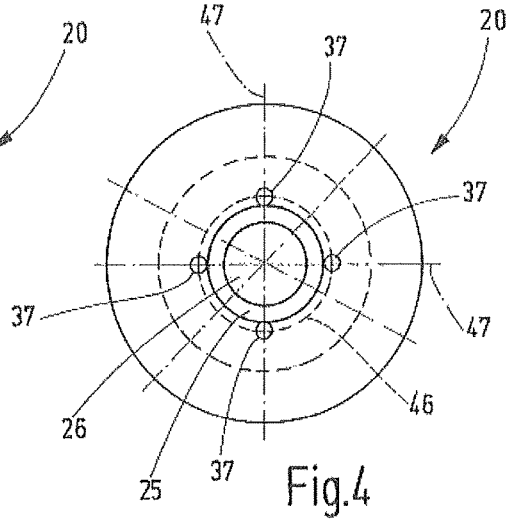

Both in the illustrative embodiment according to FIG. 3 and in the illustrative embodiment according to FIG. 4, the plasma ignition torches 37 are arranged in a uniformly distributed manner in circumferential direction U around the burner center line A. They are each located adjoining a partition wall 27, 28 delimiting the fuel duct 25, ensuring that there is very good contact between the plasma flame 42 and the pulverized coal K emerging from the fuel duct 25, which leads to stable ignition of combustion.

In general terms, the following rules apply, in the illustrative embodiment, to the arrangement of the at least one plasma ignition torch 37 in the pulverized coal burner 20 embodied as an annular burner:

for the arrangement of a plasma ignition torch 37 on a circular path 46 within the core duct cross section, the following applies:

$$\frac{dK}{D1} \geq 0.5;$$

for the arrangement of a plasma ignition torch 37 on a circular path 46 within the fuel duct cross section, the following applies: D1<dB<D2;

for the arrangement of a plasma ignition torch 37 on a circular path 46 within the secondary duct cross section, the following applies:

$$\frac{dS}{D2} \leq 1.5;$$

This ensures that the spacing between the plasma ignition torch 37 and the fuel duct outlet 32 is small enough, when viewed transversely to the burner center line A, to ensure sufficient contact between the plasma flame 42 and the pulverulent fuel, that is to say, according to the example, the pulverized coal K.

Figure 5:
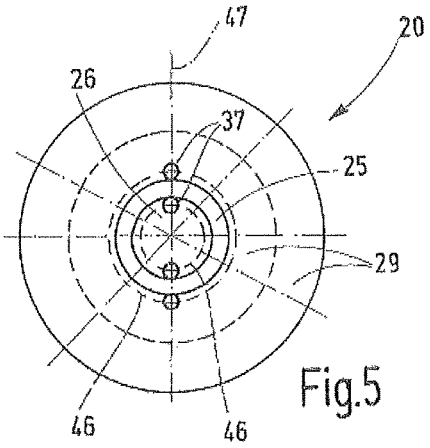

Another modification of the illustrative embodiments shown in FIGS. 3 and 4 is illustrated in FIG. 5. There, a plurality of and, according to the example, in each case two plasma ignition torches 37 are in each case arranged adjacent to the fuel duct outlet 32, both immediately adjoining the inner, first partition wall 27 and also adjoining the outer, second partition wall 28. In this embodiment, too, a total of four plasma ignition torches 37 is provided. In this illustrative embodiment, the plasma ignition torches 37 are located in a common radial plane 47.

The plasma ignition torches 37 provided can be arranged within the core duct cross section and/or within the fuel duct cross section and/or within the secondary duct cross section. In the illustrative embodiment shown in FIG. 7, at least one plasma ignition torch 37 is arranged within each of the three duct cross sections. According to the example, all the plasma ignition torches 37 present are located on different radial planes 47 and different concentric circles 46.

Figure 8:
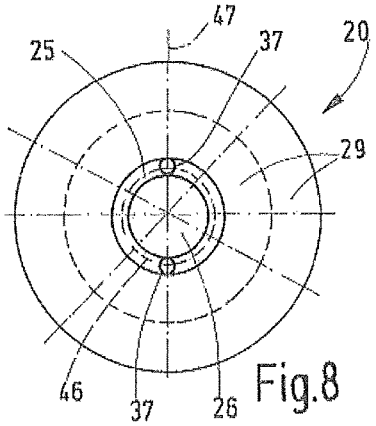

As illustrated by way of example in FIG. 8, it is also possible to arrange all the plasma ignition torches 37 within the fuel duct cross section. The arrangement of a plasma ignition torch 37 within the fuel duct cross section does not mean that the plasma flame 42 is arranged within the fuel duct 25. Only the gas duct 38 extends through the annular fuel duct 25, between the two partition walls 27, 28. The gas duct outlet 39 is outside the fuel duct 25. This applies to all the illustrative embodiments. In the example shown in FIG. 8, there are two plasma ignition torches 37, which are arranged diametrically opposite on a common radial plane 47. As a modification thereof, it would also be possible for more than two plasma ignition torches 37 to be provided.

Figure 9:
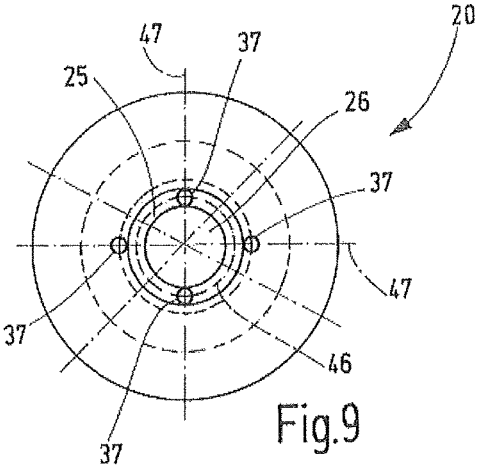
Figure 10:
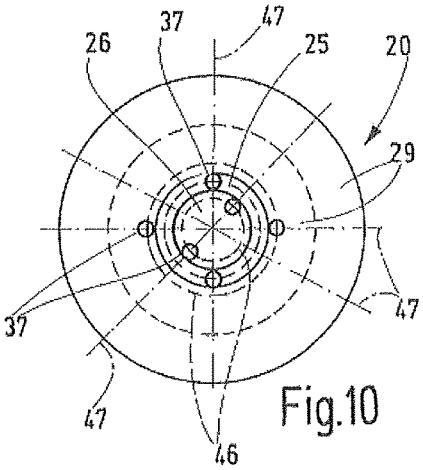

In FIG. 9, the illustrative embodiment shown in FIG. 8 is modified inasmuch as a plurality of additional plasma ignition torches 37, according to the example two additional plasma ignition torches 37, is additionally arranged in the secondary duct cross section, immediately adjacent to the second partition wall 28. When viewed in circumferential direction U, all the plasma ignition torches 37 are arranged in a regularly distributed manner. In the present case, a total of four plasma ignition torches 37 is provided. As a modification thereof, a plurality of additional plasma ignition torches 37 could also additionally be arranged within the core duct cross section, as illustrated in FIG. 10. The plasma ignition torches 37 arranged within the same cross section, i.e. within the core duct cross section or within the fuel duct cross section or within the secondary duct cross section, are each located in a common radial plane 47.

Figure 11:
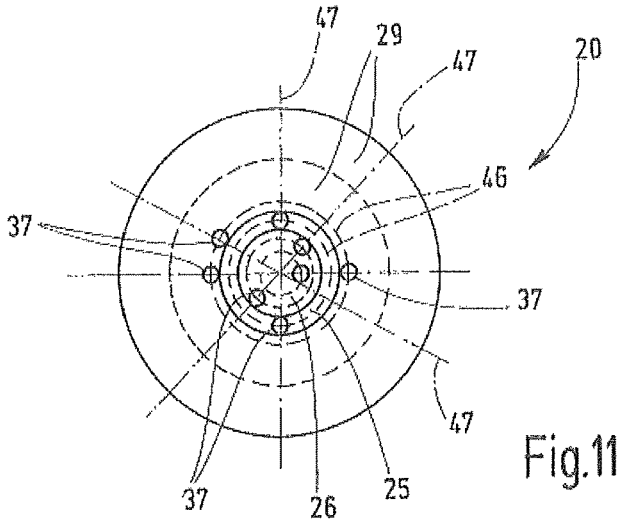

FIG. 11 shows another possible arrangement of, for example, eight plasma ignition torches 37. Two plasma ignition torches 37 are arranged within the fuel duct cross section and three plasma ignition torches 37 are arranged within the core duct cross section and the secondary duct cross section respectively. The plasma ignition torches 37 are arranged in an irregularly distributed manner in various radial planes 47 and on different circles 46.

As a modification of the possible arrangements shown, there are many other ways of arranging a different number of plasma ignition torches 37 on the pulverized coal burner 20. In principle, all combinations of the possible arrangements shown in FIG. 2 can be implemented. Arrangements in which at least one plasma ignition torch 37 is arranged directly on a partition wall 27, 28 bounding the fuel duct are preferred.

Figure 12:
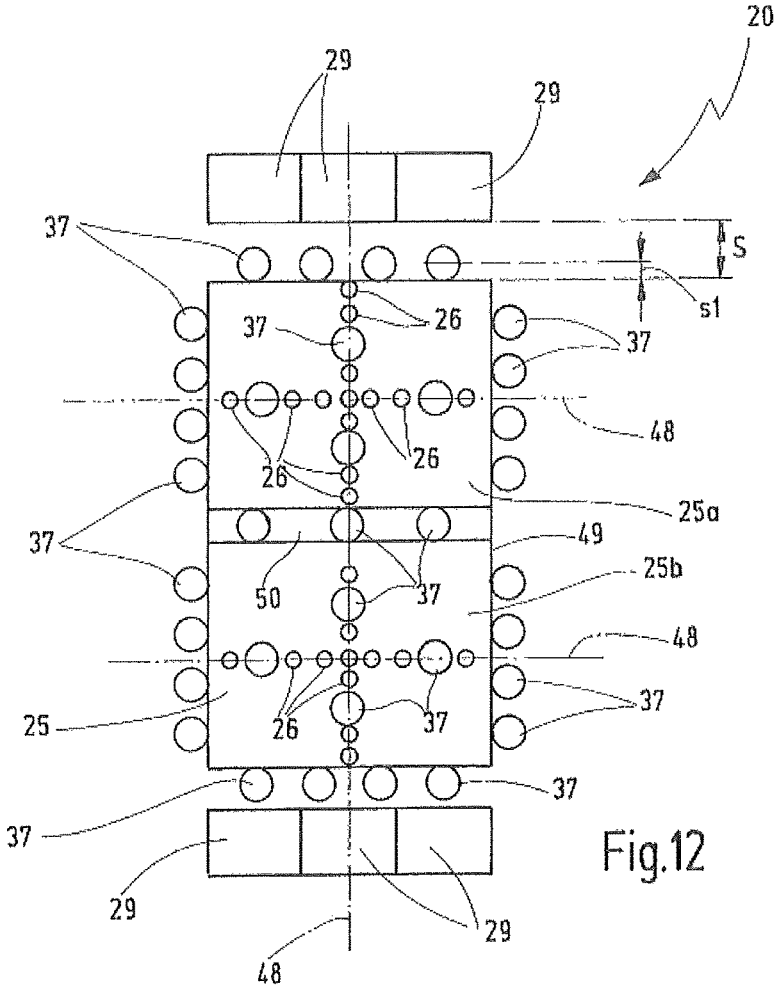
FIG. 12 shows a modified illustrative embodiment of a burner embodied as a pulverized coal burner for burning a pulverulent fuel, having a rectangular fuel duct cross section and a plurality of integrated plasma ignition torches, in a schematic plan view of the burner duct outlet.

FIG. 12 shows a pulverized coal burner 20 which, unlike the illustrative embodiments described above, is not embodied as an annular burner. The positions indicated in FIG. 12 for the plasma ignition torches 37 are not all occupied. The plasma ignition torches 37 shown in FIG. 12 indicate only the positions at which a plasma ignition torch can be arranged, as is the case also in FIG. 2.

The fuel duct 25 has a rectangular cross section. In contrast to the other embodiments, a plurality of cylindrical core ducts 26 is provided in the illustrative embodiment shown in FIG. 12. The core ducts 26 are arranged along axes 48. The axes 48 form a cross or grid structure within the fuel duct cross section. In the illustrative embodiment shown in FIG. 12, two axes 48 are arranged in parallel and spaced apart, intersecting the two long sides of the rectangular fuel duct 25. An axis 48, which represents the bisector of the two shorter sides of the fuel duct 25, extends at right angles thereto. The number of axes 48 can vary.

A plurality of plasma ignition torches 37 is furthermore arranged along said axes 48, in each case between two core ducts 26. In addition, additional plasma ignition torches 37 can be arranged on the outer duct wall 49 delimiting the rectangular fuel duct 25. In the illustrative embodiment, these torches can be located along all four sides of the outer duct wall 49 of the fuel duct 25.

In the illustrative embodiment shown here, the fuel duct 25 is divided into two duct sections 25*a* and 25*b*. For this purpose, a dividing wall 50 is arranged between the two shorter sides of the outer duct wall 49. The dividing wall 50 can have cooling air ducts. In the illustrative embodiment described here, additional plasma ignition torches 37 are arranged in the region of the dividing wall 50.

In the illustrative embodiment shown, a plurality of secondary ducts 29 is provided at a distance S from the outer duct wall 49. The secondary ducts 29 can be arranged adjacent to a short side of the outer duct wall 49 and/or to a long side of the outer duct wall 49, at a distance S. In the illustrative embodiment shown in FIG. 12, three secondary ducts 29 in each case are arranged on opposite sides of the fuel duct 25, according to the example adjacent to a short side of the outer duct wall 49 in each case. According to the example, the secondary ducts 29 have a rectangular cross section. The secondary ducts 29 arranged adjacent to a common side of the outer duct wall 49 adjoin one another directly without a spacing.

At least one plasma ignition torch 37 is arranged at least between one of the secondary ducts 29 and the fuel duct 25, with a distance s1 between the center of the outlet of said torch and the outer duct wall 49, preferably in such a way that the following applies:

$$\frac{s1}{S} \leq 0.5$$

where s1: is the distance between the center of the outlet 39 of the plasma ignition torch 37 and the duct wall 49, and S: is the distance between the adjacent secondary duct 29 and the duct wall 49.

This ensures sufficient contact between the pulverulent fuel, according to the example the pulverized coal K, and the plasma flame 42.

In the illustrative embodiment shown in FIG. 12 too, the fuel duct outlet 32, the secondary duct outlet 31 and the core duct outlet 30 form the burner outlet 33 in a common plane E. The gas duct outlets 39 of the plasma ignition torches 37 are preferably likewise located in the plane E offset downstream of the plane E or the burner outlet 33.

The invention relates to a pulverized coal burner 20 for a steam generator. The pulverized coal burner 20 has a fuel duct 25, through which pulverized coal K flows with the aid of a carrier gas. Together with the carrier gas, the pulverized coal K emerges at a fuel duct outlet 32. The pulverized coal burner 20 furthermore has at least one core duct 26 and at least one secondary duct 29. Air L flows through the core duct 26 and the secondary duct 29, emerging at the core duct outlet 30 and the secondary duct outlet 31 respectively. The core duct outlet 30, the secondary duct outlet 31 and the fuel duct outlet 32 together form a burner outlet 33. The pulverized coal burner 20 has at least one plasma ignition torch 37 embodied integrally with the pulverized coal burner 20. The outlet 39 of the at least one plasma ignition torch 37 is arranged in the plane E of the burner outlet 33 or offset downstream in relation to the direction of flow of the pulverized coal K. The plasma flame 42 produced by the plasma ignition torch 37 is thus located outside the fuel duct 26.

The invention claimed is:

1. A pulverized coal burner, comprising:

a core duct, through which air or oxygen flows and emerges at a core duct outlet;

a fuel duct, through which pulverized coal flows and emerges at a fuel duct outlet;

a plasma ignition torch, which produces a plasma flame arranged outside the fuel duct and that comes into contact with the pulverized coal downstream of the fuel duct outlet;

wherein the plasma ignition torch is arranged outside a burner center line in the core duct.

2. The pulverized coal burner as claimed in claim 1, wherein the plasma ignition torch has a gas duct and ignition electrodes arranged in the region of the gas duct outlet.

3. The pulverized coal burner as claimed in claim 2, wherein the fuel duct outlet and the core duct outlet are arranged in a common plane and there form a burner outlet.

4. The pulverized coal burner as claimed in claim 2, wherein the gas duct outlet and the fuel duct outlet are arranged in a common plane.

5. The pulverized coal burner as claimed in claim 1, further comprising at least one secondary duct and/or a plurality of core ducts.

6. The pulverized coal burner as claimed in claim 5, wherein a plurality of plasma ignition torches are arranged within at least one of the core duct cross section, the coal duct cross section and the at least one secondary duct cross section.

7. The pulverized coal burner as claimed in claim 6, wherein at least one plasma ignition torch of the plurality of plasma ignition torches is arranged directly on a partition wall between the fuel duct and the core duct.

8. The pulverized coal burner as claimed in claim 6, wherein at least one plasma ignition torch of the plurality of plasma ignition torches is arranged directly on a partition wall between the fuel duct and the at least one secondary duct.

9. The pulverized coal burner as claimed in claim 6, wherein the plasma ignition torches are arranged on one or more concentric circles around the burner center line.

10. The pulverized coal burner as claimed in claim 6, wherein a plurality of radial planes are defined radially with respect to the burner center line, and wherein at least some of the plasma ignition torches of the plurality of plasma ignition torches are arranged in different ones of the plurality of radial planes.

11. The pulverized coal burner as claimed in claim 10, wherein the angles between a radial plane of the plurality of radial planes and two radial planes immediately adjacent thereto are different in the circumferential direction around the burner center line.

12. The pulverized coal burner as claimed in claim 6, wherein air or oxygen flows out of the core duct or out of the at least one secondary duct between two plasma ignition torches.

13. The pulverized coal burner as claimed in claim 1, wherein the fuel duct is embodied as an annular duct and surrounds the core duct coaxially.

14. The pulverized coal burner as claimed in claim 1, wherein the secondary duct is embodied as an annular duct and surrounds the fuel duct coaxially.

15. The pulverized coal burner as claimed in claim 1, wherein the fuel duct has a rectangular coal duct cross section.

16. A pulverized coal burner as claimed in claim 15, wherein a plurality of core ducts and/or a plurality of plasma ignition torches is/are arranged within the coal duct cross section, wherein the core duct outlets and/or the plasma ignition torches are arranged along axes which form a cross or grid structure.

17. The pulverized coal burner as claimed in claim 16, wherein at least one plasma ignition torches is immediately adjacent to two core ducts.

18. The pulverized coal burner as claimed in claim 15, wherein at least one plasma ignition torch is arranged between the fuel duct and the secondary air duct.

19. The pulverized coal burner as claimed in claim 1, wherein the fuel duct outlet and the core duct outlet are arranged in a common plane and there form a burner outlet.

* * * * *